United States Patent [19]

Brastad et al.

[11] 4,048,786

[45] Sept. 20, 1977

[54] CIRCULAR PACKAGE LOADER

[75] Inventors: William A. Brastad, Minneapolis; Nelson J. Beall, St. Michael, both of Minn.

[73] Assignee: General Mills, Inc., Minneapolis, Minn.

[21] Appl. No.: 616,749

[22] Filed: Sept. 25, 1975

[51] Int. Cl.[2] ..... B65B 5/06; B65B 25/00; B65B 35/22; B65B 67/02

[52] U.S. Cl. ..... 53/159; 53/235; 53/391; 53/392

[58] Field of Search ..... 53/13, 143, 159, 243, 53/247, 248, 390–392, 26, 235

[56] References Cited

U.S. PATENT DOCUMENTS

| | | | |
|---|---|---|---|
| 2,013,555 | 9/1935 | Deeren | 53/392 X |
| 3,113,660 | 12/1963 | Clements | 53/159 X |
| 3,889,445 | 6/1975 | Brash | 53/159 X |

*Primary Examiner*—Robert Louis Spruill
*Attorney, Agent, or Firm*—G. O. Enockson; L. M. Lillehaugen

[57] ABSTRACT

Apparatus is provided which moves a column of nested, uniformly shaped chips into a reservoir thereby forming a loop array. The loop array of snack chips is then transferring from the reservoir into a package.

6 Claims, 9 Drawing Figures

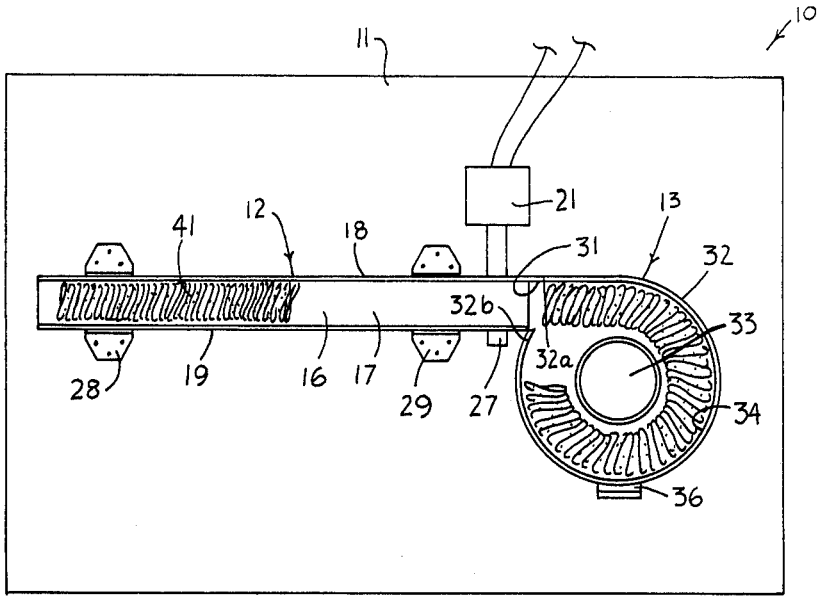
FIG. I
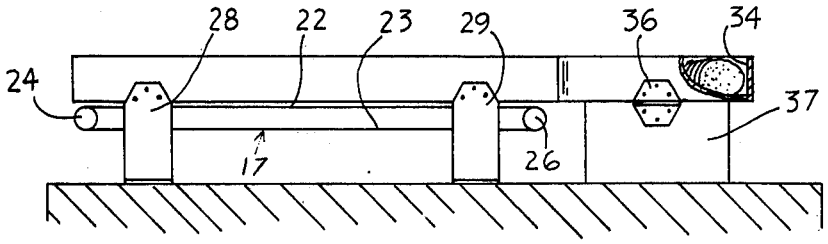
FIG. II
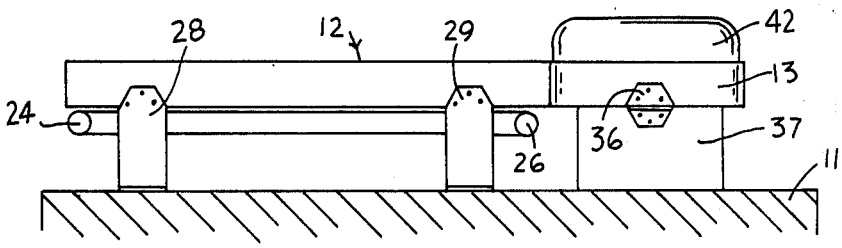
FIG. III
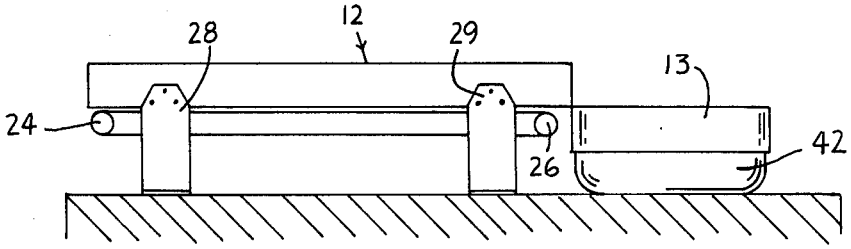
FIG. IV

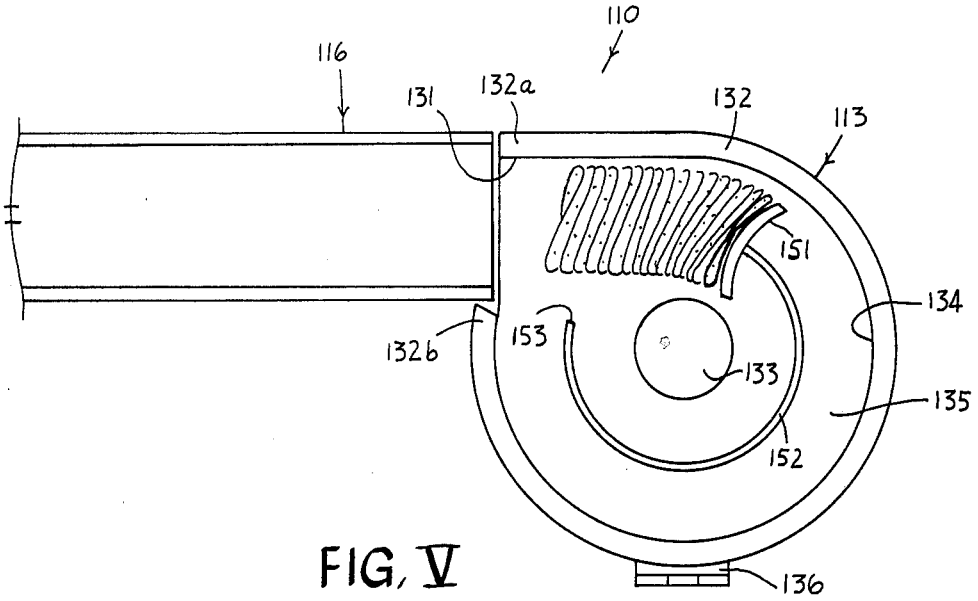
FIG. V
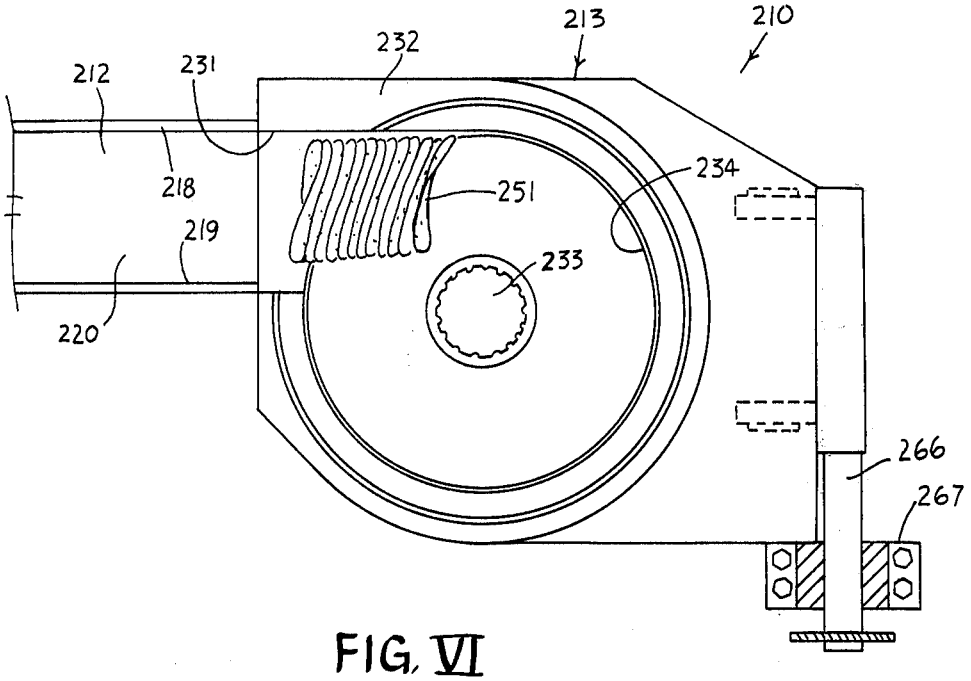
FIG. VI

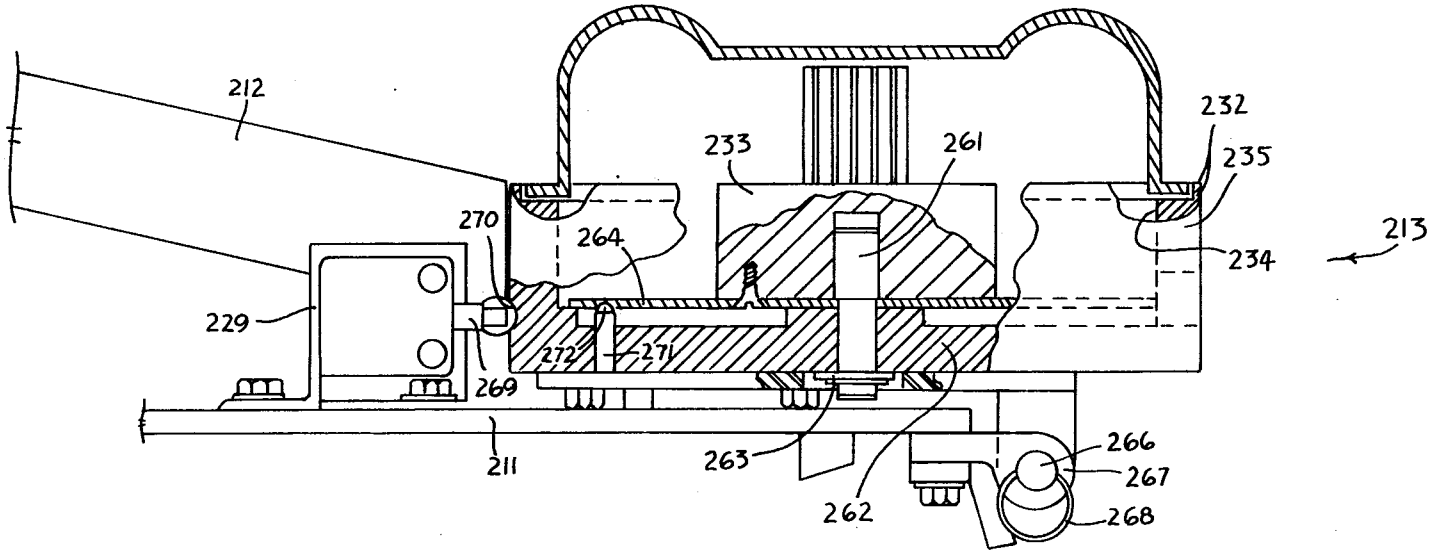
FIG. VII

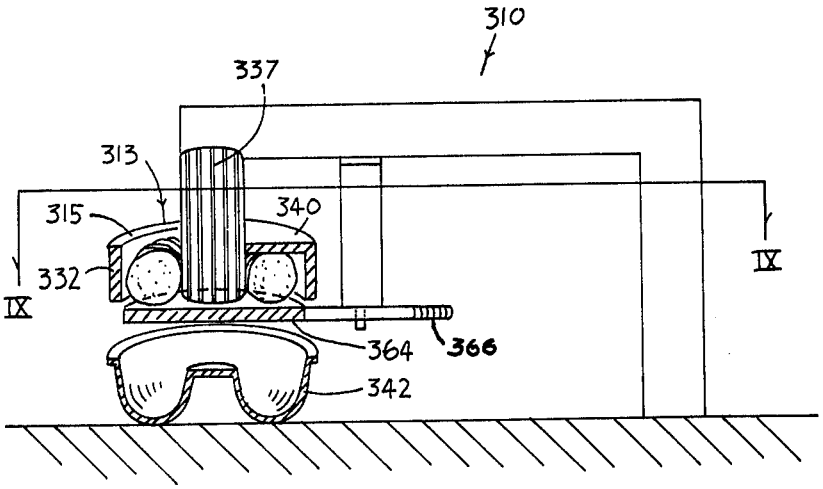
FIG. VIII
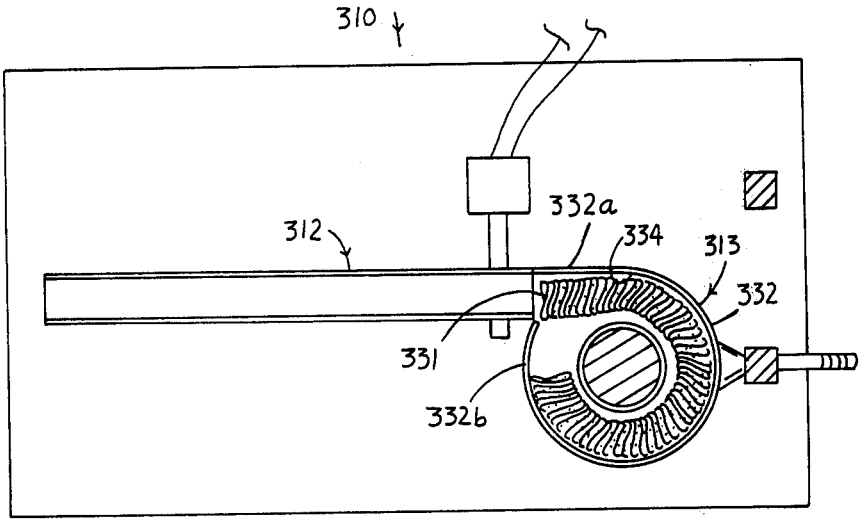
FIG. IX

CIRCULAR PACKAGE LOADER

BACKGROUND OF THE INVENTION

The present invention relates to apparatus for handling and packaging food products, and more particularly to handling and packaging of chip-type food products.

A variety of types of packaging equipment has been available in the past. Chip-type food products, for example, may be inserted into a bag in a random manner merely by dropping the chips through a chute directed into the bag. Such package filling equipment is not suitable for packaging uniformly shaped, nested chips. Packaging of nested chips may be carried out by hand; however, this technique is time consuming and costly. Depositing of uniformly shaped nested chips in the loop array package as disclosed in commonly assigned U. S. Pat. No. 3,852,485 is particularly difficult. The present invention overcomes such difficulties and provides automated equipment for packaging of uniformly shaped, nested snack chips in a loop array.

THE PRESENT INVENTION

The apparatus of the present invention includes a mechanism for moving a straight column of nested snack chips into a reservoir in a loop or arc arrangement. The loop or arc of nested chips is then deposited in a circular package. The terms "chip", "snack chip" and the like, as used herein, will refer to thin, rigid slices of food products having a uniform shape such as that shown in U. S. Pat. No, 3,852,485. The chips may typically be potato chips, wheat chips, rye chips, rice chips and the like.

IN THE DRAWINGS

FIG. 1 shows a top view of one enbodiment of the present invention;

FIGS. II–IV are side views of the embodiment shown in FIG. I;

FIG. V is an alternative embodiment of the loading reservoir of the present invention;

FIGS. VI–VII show another embodiment of the loading reservoir;

FIGS. VIII–IX show a further embodiment of the present invention.

DETAILED DESCRIPTION

The loading apparatus 10 of the present invention, one embodiment of which is shown in FIGS. I–IV , includes a support structure 11, an inlet track or chip-feeding section 12, and a loading reservoir 13.

The support structure 11 may comprise any suitable support such as a table and may, for example, be constructed of stainless steel stock.

The chip-feeding section 12 has an inlet track 16 that may include a continuous belt 17 and a pair of side rails 18 and 19. The continuous belt 17 may be driven such as by an electrically powered motor 21. The continuous belt 17 may have an upper reach 22 and a lower reach 23. The belt 17 may be supported on a pair of pulleys 24 and 26. Pulley 26 may be mounted on the shaft 27 of motor 21. The side rails or guards 18 and 19 may be suitably supported on table 11 such as by legs 28 and 29.

The loading reservoir 13 may have a convolute shape as shown in FIG. I; the reservoir 13 has a side wall 32 and a center hub 33. The two ends **32*a* and 32*b* of side wall 32 define an opening 31. A channel 34 is defined between side wall 32 and hub 33. The reservoir 13 may be formed of any suitable material, for example, it may be machined from aluminum stock or it may be formed of a plastic-like material such as a nylon or a Delron™ material. The reservoir 13 may be mounted on a hinge 36 for pivotable movement and may be supported such as on a block 37 (FIG. II). The reservoir 13 is preferably vibrated by conventional means to assist in movement of the chips in channel 34**.

OPERATION OF THE INVENTION

Although operation of the present invention would be apparent from reading the afore description, it will be further detailed hereinafter. A column of nested chips such as 41 may be conveyed along the inlet track 12 by the continuous belt 17. In other words, the column of chips 41 rests on the upper reach 22 of the belt 17 as the column is moved rightwardly in FIG. I. If desired, the column of chips may be of a measured length using apparatus as shown in U.S. Pat. No. 2,650,010. The side rails 18 and 19 maintain the chips in the column formation. The belt 17 carries the column of chips 41 into and through opening 31 in reservoir 13. The column of chips 41 follow the channel 34 in the reservoir 13. The operator may assist movement of the column 41 such as by placing his finger against the last chip in the column and urging the column forwardly. As the last chip in the column passes through the opening 31, the operator may shift the trailing portion of the column radially inwardly toward the hub 33 thereby aligning said trailing end of the column with the leading end of the column. Thus, the column of chips 41 has been moved into a continuous ring of nested chips. Alternatively, a mechanized finger may move the trailing end of the column in a similar manner.

A suitable container 42 (FIG. III) may be superimposed over the reservoir 13 and held thereagainst by the machine operator as he pivots the reservoir into the position shown in FIG. IV. The ring of chips then drop into the container 42. The reservoir then may be returned to the position shown in FIG. I and the package 42 may be removed for any further wrapping or processing.

ALTERNATIVE EMBODIMENTS

Various modifications of the present invention may be made without departing from the broader scope thereof. The conveyor, for example, may be of any other suitable type such as a chain or a vibrating trough.

An alternative embodiment 110 is shown in FIG. V. The apparatus 110 has a conventional vibrating trough 116 that serves to feed a column of nested chips to a loading reservoir 113. The loading reservoir 113 is shown having a convolute shape with an upstanding radially outer wall 132, a floor 135 and a hub 133. A channel 134 is defined by wall 132, floor 135, and hub 133. An opening 131 into reservoir 113 is defined by the two ends **132*a* and 132*b* of wall 132. A movable blade 151 is mounted for movement along a track 152. The blade 151 may have a shape substantially similar to the leading surface of the column of uniform chips. As the column of chips moves forwardly into the loading reservoir 113, the first chip abuts against the blade 151 and forces blade 151 along track 152. The blade 151 thus leads the column of chips along the channel 134. The blade 151 is then stopped at the forward end 153 of the track 152. At this point, the machine operator may assist movement of the column of chips to align the trailing end of the column with the leading end of the column, thereby forming the loop array. A container may be superimposed over the reservoir 113, as previously described, and the reservoir 113 may be inverted by pivoting on hinge 136 to deposit the ring of chips into the container in a manner similar to that described with respect to loading apparatus 10. The blade 151 may be returned along the track 152** to the starting position.

A further embodiment 210 of the present invention is shown in FIGS. VI and VII. The apparatus 210 includes support table 211, an inclined gravity fed track 212, and a loading reservoir 213. The track 212 may be fabricated of stainless steel sheet. The track 212 may include a pair of side walls 218 and 219, as well as a floor 220. The track 212 may be mounted on legs such as leg 229 which are secured to table 211. by suitable means.

The reservoir 213 includes a body portion 235 having a side wall 232 and a center hub 233. A channel 234 is defined between the wall 232 and the hub 233. The hub 233, in this instance, is rotatably mounted in the reservoir 213 such as by shaft 261. Shaft 261 is integrally mounted in hub 233 at its upper end and is rotatably mounted in the floor 262 of reservoir 213. The shaft 261 may be secured in position by lock ring 263, thus hub 233 may rotate with respect to wall 232. If desired, reservoir 213 may be provided with a rotatable platform 264 which is integrally secured to hub 233. A column of chips may be supported on platform 264. Hub 233 and platform 264 may be rotated to move the column into a ring configuration.

The reservoir 213 has a shaft 266 secured thereto which is rotatably mounted in a support bearing 267. The support bearing may be suitably secured to the table. The shaft 266 may be held in place by retaining ring 268.

The reservoir 213 may be releasably held in position adjacent track 212 by a detent 269 which is mounted on leg 229. The detent engages in a recess 270 defined in body 235 of reservoir 213. A further detent 271 may be provided to releasably lock the rotatable platform in the starting position shown in FIG. VI. The detent 271 is mounted in floor 262 of body 235 and is releasably engaged in a recess 272 defined in plaatform 264.

Another embodiment 310 is shown in FIGS. VIII and IX. The loading apparatus 310 includes a feeding track 312 and a loading reservoir 313. The feeding track 312 may be constructed substantially as described with respect to track 12 in FIGS. I-IV. The reservoir 313 may include a body portion 315 and a moveable platform 364. The body portion 315 has a side wall 332 defining a convolute channel 334. The side wall 332 includes an upper horizontal flange 340 whereby the reservoir 313 may be mounted on a support member 337. The two ends 332a and 332b of wall 332 define an opening 331 through which a column of chips may move into the channel 334. An opening 341 is provided through which the operator may align the trailing end of the column of chips with the leading end to provide a ring of chips. The platform 364 is pivotably mounted on support arm 365 such as by a pin (not shown). The platform 364 has a handle 366.

Operation of loading apparatus 310 is substantially similar to the operation of apparatus 10. A column of chips is moved along track 312 and into the reservoir 313. The trailing end of the column is aligned with the leading end of the column. In this instance, the platform 364 is moved sidewardly from beneath the ring of chips and the chips drop into the package 342.

Various other modifications may be made without departing from the broader scope of the present invention. For example, platform 364 may be replaced with a plurality of gates making up an iris.

The embodiment of the invention in which an exclusive property or privilege is claimed are defined as follows:

1. Apparatus for loading a column of snack chips into a container as a loop array, said apparatus comprising:
- reservoir means;
- means for feeding a column of nested, uniformly shaped chips into said reservoir means, said reservoir means including means for holding said nested chips in a loop array;
- means for transferring said loop array of nested chips from said reservoir means into a container while maintaining said chips in said loop array;
- said reservoir means including means for assisting in movement of said column into a loop array orientation as said nested chips are fed into said reservoir means, said assisting means including an arcuate reservoir side wall.

2. The apparatus of claim 1 wherein said assisting means further include moveable blade means for leading the column of chips into and along an arcuate path.

3. The apparatus of claim 1 wherein said means for transferring comprise means for inverting said reservoir means over said container.

4. The apparatus of claim 3 wherein said means for inverting comprise hinge means.

5. The apparatus of claim 1 wherein said means for transferring are movable gate means comprising the bottom of said reservoir and wherein said gate means may be moved to permit the loop array to drop into said container.

6. The apparatus of claim 1 wherein said reservoir means has a side wall defining an opening through which a column of chips may enter said reservoir.

* * * * *